US008085939B2

(12) United States Patent
Lee et al.

(10) Patent No.: US 8,085,939 B2
(45) Date of Patent: Dec. 27, 2011

(54) STEREOPHONIC SOUND REPRODUCTION SYSTEM FOR COMPENSATING LOW FREQUENCY SIGNAL AND METHOD THEREOF

(75) Inventors: Jun-Ho Lee, Seoul (KR); Dae Hee Youn, Seoul (KR); Young Cheol Park, Gangwon-Do (KR); Tae Ik Kang, Gyeonggi-Do (KR); Jeong-Tae Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 1450 days.

(21) Appl. No.: 11/394,467

(22) Filed: Mar. 30, 2006

(65) Prior Publication Data

US 2006/0239464 A1 Oct. 26, 2006

(30) Foreign Application Priority Data

Mar. 31, 2005 (KR) ..... 10-2005-0027137

(51) Int. Cl.
*H04R 5/00* (2006.01)

(52) U.S. Cl. ..... 381/1; 381/309; 381/17; 381/71.1; 381/74; 381/99

(58) Field of Classification Search ..... 381/1, 309, 381/17, 71.1, 74, 99
See application file for complete search history.

(56) References Cited

U.S. PATENT DOCUMENTS

| | | | | |
|---|---|---|---|---|
| 5,727,066 | A * | 3/1998 | Elliott et al. | 381/1 |
| 6,504,933 | B1 * | 1/2003 | Chung | 381/1 |
| 7,778,321 | B2 * | 8/2010 | Chou et al. | 375/232 |
| 2003/0026441 | A1 * | 2/2003 | Faller | 381/98 |

* cited by examiner

*Primary Examiner* — Vivian Chin
*Assistant Examiner* — Paul Kim
(74) *Attorney, Agent, or Firm* — Lee, Hong, Degerman, Kang & Waimey

(57) ABSTRACT

A stereophonic sound reproduction system for compensating a low frequency signal and a method thereof, wherein a mono component signal for compensating low frequency signals which are attenuated when removing a crosstalk of inputted left and right signals inputted is calculated using an average value between the left and right signals, left and right compensation gains which are inversely proportional to an absolute value of a power difference value between the first left and right signals, an amplitude of the calculated mono component signal is controlled according to the left and right compensation gains, and thereafter the mono component signal with the controlled amplitude is added to the left and right signals when removing the crosstalk, whereby the left and right signals from which the crosstalk is removed and to which the mono component signal is added are outputted through left and right speakers to thus prevent distortion of the low frequency signals of original stereophonic sound with maintaining a stereophonic sound effect.

15 Claims, 5 Drawing Sheets

STEREOPHONIC SOUND REPRODUCTION SYSTEM FOR COMPENSATING LOW FREQUENCY SIGNAL AND METHOD THEREOF

CROSS REFERENCE TO RELATED APPLICATIONS

Pursuant to 35 U.S.C. §119(a), this application claims the benefit of earlier filing date and right of priority to Korean Patent Application No. 10-2005-0027137, filed on Mar. 31, 2005, the content of which is hereby incorporated by reference herein in its entirety.

BACKGROUND OF THE INVENTION

1. Field of the Invention

The present invention relates to a stereophonic sound reproduction system, and particularly, to a stereophonic sound reproduction system for compensating a low frequency signal which is attenuated when removing a crosstalk (i.e., cross-signal interference), and a compensation method thereof.

2. Background of the Invention

In general, a stereophonic sound reproduction system purposes a reproduction of an original sound of sound a person wants to listen to around his ears. The stereophonic sound reproduction system can be implemented by use of equipment for controlling stereophonic sound such as a playback (e.g., an MPEG-1 audio layer 3 (MP3)) or a Compact Disk Player (CDP) and equipment for reproducing the stereophonic sound such as a headset or a speaker.

Here, as illustrated in FIG. 1, upon reproducing stereo using speakers $SP_L$ and $SP_R$, a large space to reproduce sound is ensured, which causes a crosstalk which the stereophonic sound of the left speaker $SP_L$ and that of the right speaker $SP_R$ are listened by being mixed.

That is, the sound coming from the right speaker $SP_R$ should be transferred only to the person's right ear, but it is actually transferred to his left ear as well. Similarly, the sound coming from the left speaker $SP_L$ should be transferred only to his left ear, but it is actually transferred to his right ear as well. Accordingly, the crosstalk occurs such that the person listens to more distorted sound with his ears as compared to listening to sound through an headset.

In order to solve the occurrence of the crosstalk in the typical stereophonic sound reproduction system, a compensating filter disposed at a front portion of an input port of each speaker is used to implement a crosstalk canceller for removing the crosstalk. However, when the stereophonic sound reproduction system is implemented using the typical crosstalk canceller, the performance of the crosstalk canceller is problematically lowered at a low frequency band.

FIG. 2 illustrates a transfer function of a sound source which is reproduced in a stereophonic sound reproduction system equipped with a typical crosstalk canceller.

In particular, FIG. 2 illustrates a transfer function that a left sound source is got to both left and right ears when a stereophonic sound reproduction system equipped with a typical crosstalk canceller reproduces stereophonic sound with positioning left and right speakers by ±30° based upon a listener.

Here, a solid line denotes a transfer function that the left sound source is got to the listener's left ear, and a dotted line denotes a transfer function that the right sound is got to his right ear.

For an ideal crosstalk canceller, the solid line must be 0 dB because the sound source must be transferred as it is without distortion. The dotted line must be −∞dB because the sound source must not be transferred.

However, in the crosstalk canceller provided to the typical stereophonic sound reproduction system, as shown in FIG. 2, the solid line (i.e., the transfer function that the left sound source is transferred to the left ear) is −5 dB level at a low frequency band of about 50~300 Hz and thus is close to the dotted line (i.e., the transfer function that the right sound source is transferred to the right ear).

Therefore, in the stereophonic sound reproduction system equipped with the typical crosstalk canceller, the typical crosstalk canceller may not remove the crosstalk well at the low frequency band to thereby attenuate a mono component signal which is positioned at the low frequency band.

The attenuation of the mono component signal may be solved by designing the compensating filter of the crosstalk canceller to have plural coefficients, which may cause an increase in the number of times for calculation.

SUMMARY OF THE INVENTION

Therefore, an object of the present invention is to provide a stereophonic sound reproduction system for compensating a low frequency signal which is capable of removing a crosstalk and simultaneously preventing distortion of original sound when reproducing stereophonic sound, and a compensation method thereof.

Another object of the present invention is to provide a stereophonic sound reproduction system for compensating a low frequency signal in which a low frequency signal attenuated when removing a crosstalk can be compensated with the number of times for calculation, and a compensation method thereof.

To achieve these and other advantages and in accordance with the purpose of the present invention, as embodied and broadly described herein, there is provided a stereophonic sound reproduction system for compensating a low frequency signal comprising a crosstalk removing unit for outputting second left and right signals having phases for removing a crosstalk by receiving first left and right signals, a low frequency signal compensating unit for controlling an amplitude of a mono component signal extracted from the first left and right signals according to left and right compensation gains which are calculated based upon power information of the first left and right signals, and an adding unit for calculating the mono component signal of which amplitude has been controlled to the second left and right signals, respectively.

The low frequency signal compensating unit can comprise a mono component signal extracting unit for extracting the mono component signal by performing a low pass filtering with respect to an average value between the first left and right signals, a compensation gain calculating unit for calculating the left and right compensation gains using a power difference between the first left and right signals, and a compensation mono component signal generating unit for generating a mono component signal to be compensated by controlling the amplitude of the mono component signal according to the left and right compensation gains.

According to another embodiment of the present invention, a stereophonic sound reproduction system for compensating a low frequency signal can comprise a crosstalk removing unit for removing a crosstalk from left and right signals inputted, and a low frequency signal compensating unit for compensating a low frequency signal which is attenuated when removing the crosstalk by compensating a mono component signal extracted from the left and right signals.

The mono component signal is generated according to compensation gains which have been calculated based upon information related to a power difference between the left and right signals.

The crosstalk removing unit can comprise first through four compensating filters for compensating the left and right signals using a reverse function of a special transfer function corresponding to each acoustic path, a first adder for adding output signals from the first and third compensating filters to each other to remove the crosstalk, and a second adder for adding output signals from the second and fourth compensating filters to each other to remove the crosstalk.

The low frequency signal compensating unit can comprise a low frequency band pass filter for extracting the mono component signal by performing the low pass filtering with respect to the left and right signals, a first multiplier for multiplying the mono component signal by the compensation gains calculated using the information related to the power difference between the left and right signals and outputting the multiplied mono component signal to the first adder, and a second multiplier for multiplying the mono component signal by the compensation gains and outputting the multiplied mono component signal to the second adder.

To achieve these and other advantages and in accordance with the purpose of the present invention, a stereophonic sound reproduction method for compensating a low frequency signal comprising removing a crosstalk from left and right signals inputted, generating a mono component signal to compensate a low frequency signal which is attenuated when removing the crosstalk, adding the generated mono component signal to the left and right signals when removing the crosstalk.

The generating of the mono component signal can include extracting the mono component signal from the left and right signals, calculating left and right compensation gains based upon information related to a power difference between the left and right signals, and controlling an amplitude of the mono component signal extracted according to the left and right compensating gains.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

In the present invention, a mono component signal is extracted from a stereophonic signals, compensation gains are calculated based upon power information of the stereophonic signals, and the mono component signal is compensated according to the compensation gains when removing a crosstalk, thereby removing the crosstalk and simultaneously preventing distortion of original stereophonic sound when reproducing the stereophonic signal.

Hereinafter, preferred embodiments of the present invention will now be explained with reference to the attached drawings.

Figure 1:
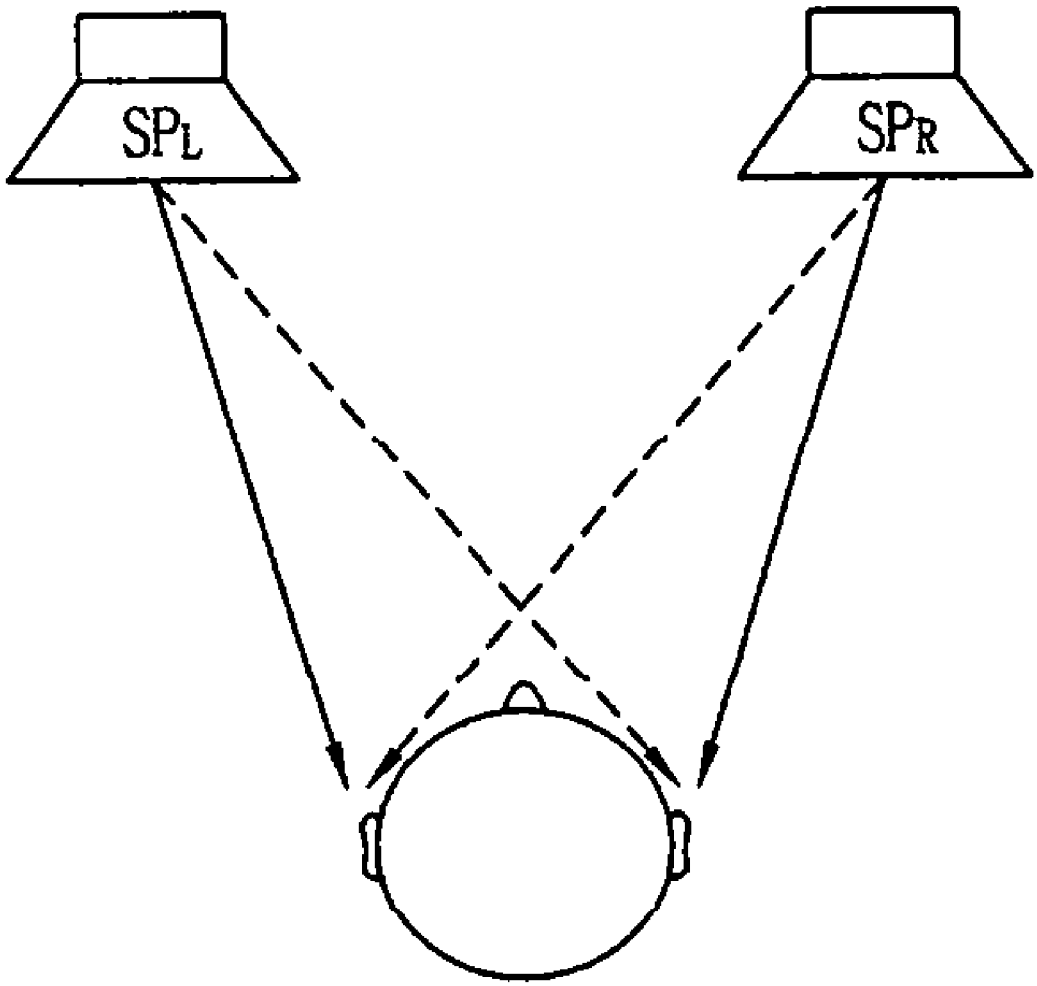
FIG. 1 RELATED ART
FIG. 1 is a diagram illustrating an acoustic path of stereophonic sound outputted through left and right speakers.
Figure 2:
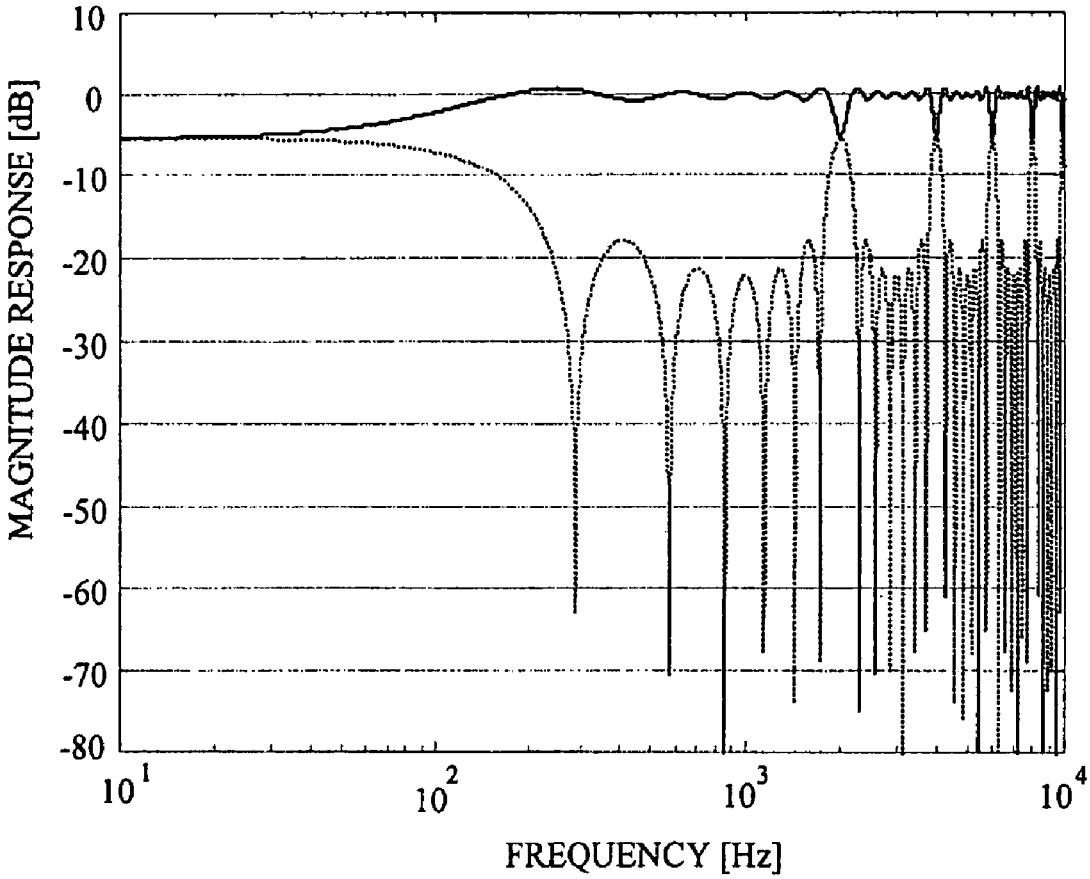
FIG. 2 RELATED ART
FIG. 2 is a diagram illustrating a transfer function of a sound source reproduced by a stereophonic sound reproduction system equipped with a typical crosstalk canceller.
Figure 3:
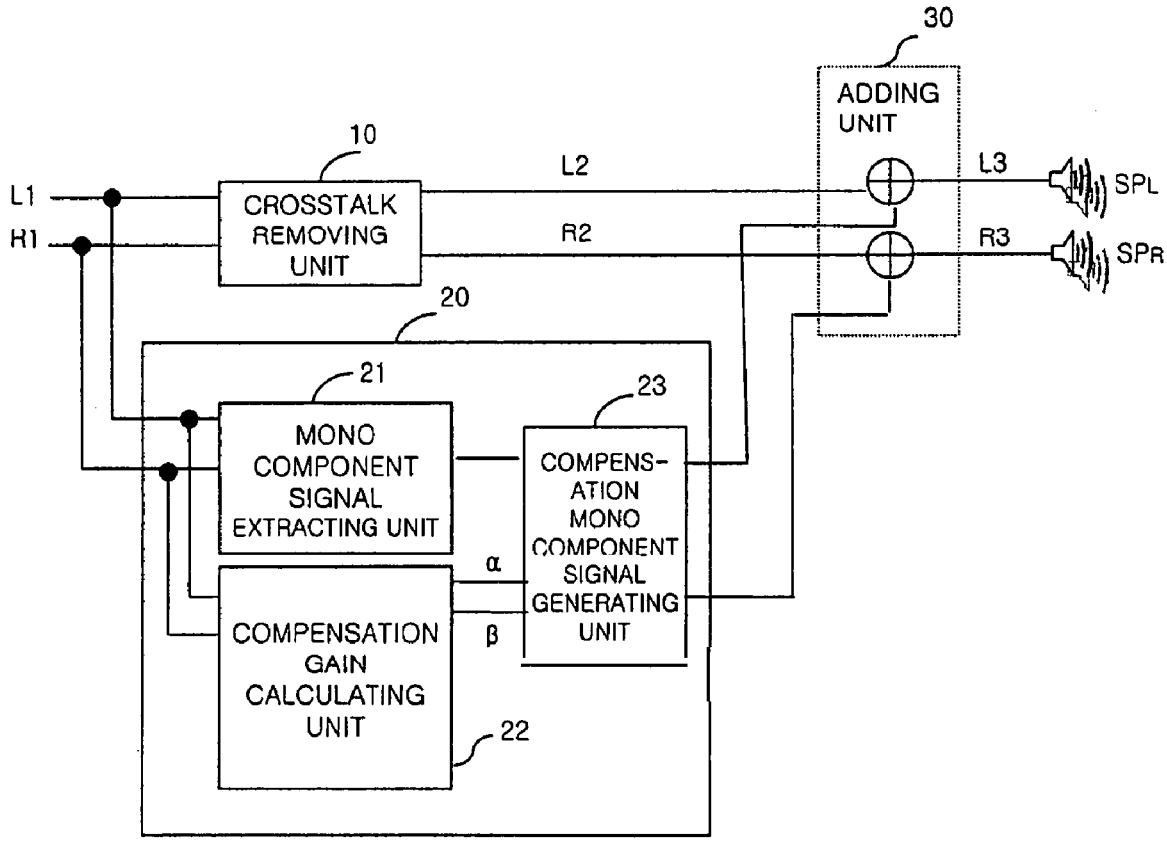
FIG. 3 is a diagram illustrating a construction of a stereophonic sound reproduction system for compensating a low frequency signal according to the present invention.

FIG. 3 is a diagram illustrating a construction of a stereophonic sound reproduction system for compensating a low frequency signal according to the present invention.

A stereophonic sound reproduction system for compensating a low frequency signal according to the present invention can comprise a crosstalk removing unit 10 for outputting second left and right signals L2 and R2 having phases for removing a crosstalk by receiving first left and right signals L1 and R1, and a low frequency signal compensating unit 20 for compensating attenuated low frequency signals of the second left and right signals L2 and R2 by use of the mono component signal extracted from the first left and right signals and compensation gains calculated based upon power information of the first left and right signals L1 and R1.

The stereophonic sound reproduction system for compensating a low frequency signal can further include an adder 30 for adding the second left and right signals L2 and R2 to the mono component signal of which amplitude has been controlled according to the compensation gains.

Figure 4:
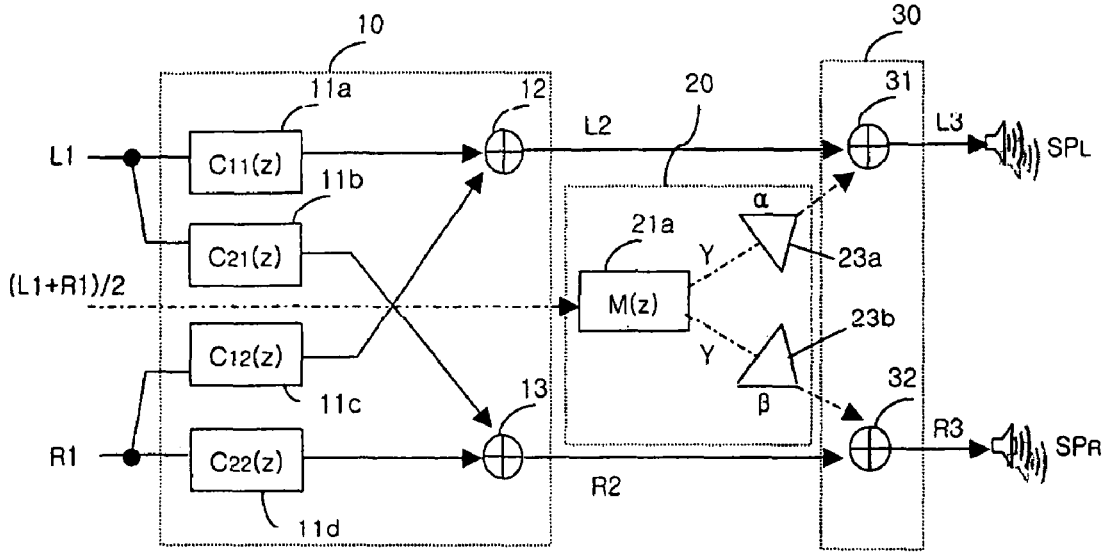
FIG. 4 is a diagram illustrating an embodiment of a detailed construction of the stereophonic sound reproduction system for compensating the low frequency signal according to the present invention.

The crosstalk removing unit 10 can be implemented as a commonly used crosstalk canceller. The crosstalk removing unit 10, as illustrated in FIG. 4, includes first through fourth compensating filters 11*a* through lid for compensating the inputted first left and right signals L1 and R1 using a reverse function of a special transfer function corresponding to each acoustic path, a first adder 12 for adding output signals from the first and third compensating filters 11*a* and 11*c* to each other to thus output the second left signal L2 having the phase for removing the crosstalk, and a second adder 13 for adding output signals from the second and fourth compensating filters 11*b* and 11*d* to each other to thus output the second right signal R2 having the phase for removing the crosstalk.

The low frequency signal compensating unit 20 can include a mono component signal extracting unit 21 for extracting the mono component signal by performing a low frequency pass filtering with respect to the first left and right signals L1 and R1, a compensation gain calculating unit 22 for calculating left and right compensation gains using a power difference between the first left and right signals L1 and R1, and a compensation mono component signal generating unit 23 for generating a mono component signal to be compensated by adjusting the mono component signal according to the left and right compensation gains.

The mono component signal extracting unit 21 can include a mono component calculating unit (not shown) for calculating an average value between the first left and right signals L1 and R1, and a low frequency band pass filter 21*a* for performing a low pass filtering with respect to the calculated average value and synchronizing the filtered average value with the second left and right signals L2 and R2 for output.

The compensation gain calculating unit 22 can include a first device (not shown) for calculating power of the first left signal L1, a second device (not shown) for calculating power of the first right signal R1, and left and right compensation gain calculating units (not shown) for calculating left and right compensation gains which should be inversely proportional to an absolute value of a power difference value between the power of the first left signal L1 and the power of the first right signal R1.

The compensation mono component signal generating unit 23, as illustrated in FIG. 4, can include first and second multipliers 23*a* and 23*b* for multiplying the mono component signal extracted from the mono component signal extracting unit 21 by each of the left and right compensation gains calculated by the compensation gain calculating unit 22 to output a left compensation mono component signal and a right compensation mono component signal, respectively.

An operation of the stereophonic sound reproduction system for compensating the low frequency signal according to the present invention having such construction will now be explained with reference to FIGS. 3 and 4.

First, stereophonic signals, namely, the first left and right signals L1 and R1 may be represented using Equation 1.

$$L1=C+L0$$

$$R1=C+R0 \qquad \text{(Equation 1)}$$

Here, C denotes a common component of the stereophonic signals L1 and R1, and is generally positioned at a low frequency band. L0 denotes an independent component of the first left signal L1, and R0 denotes an independent component of the first right signal R1.

Upon inputting the first left and right signals L1 and R1, the crosstalk removing unit 10 uses the compensating filters 11*a* through lid corresponding to each acoustic path and the first and second adders 12 and 13 so as to output second left and right signals L2 and R2 having the phases for removing the crosstalk.

The mono component signal extracting unit 21 of the low frequency signal compensating unit 20, on the other hand, calculates an average value between the first left and right signals L1 and R1, and synchronizes the calculated average value with the second left and right signals L2 and R2 by performing the low pass filtering. That is, how the mono component signal extracting unit 21 extracts the mono component signal can be indicated as shown in Equation 2.

$$Y=[(L1+R1)/2]*M(z) \qquad \text{(Equation 2)}$$

Here, (L1+R2)/2 denotes the average value between the first left and right signals L1 and R1, wherein the average value therebetween is used such that the common component (C) level of the first left and right signals L1 and R1 is relatively greater than that of each of the independent signals L0 and R0 having passed through the crosstalk removing unit 10. M(z) denotes the low frequency band pass filter 21*a* including delay required for synchronizing the average value between the first left and right signals L1 and R1 with the second left and right signals L1 and R2. In addition, "*" denotes a convolution calculation, and Y denotes the mono component signal. Therefore, the mono component signal Y is outputted by being synchronized with the second left and right signals L2 and R2.

The compensation gain calculating unit 22 of the low frequency signal compensating unit 20, on the other side, uses the power difference between the first left and right signals L1 and R1 to calculate the left and right compensation gains. The left and right compensation gains indicate compensation gains of the low frequency signals for maintaining stereophonic sound effect and simultaneously preventing distortion of original stereophonic sound. The left and right compensation gains are inversely proportional to an absolute value with respect to the different value between the power of the first left signal L1 and the power of the first right signal R1.

That is, the compensation gain calculating unit 22 can calculate the left and right compensation gains according to Equation 3 as shown herebelow.

$$\alpha = 1 - \frac{|p_L - p_R|}{|p_L + p_R|} \qquad \text{(Equation 3)}$$

$$\beta = 1 - \frac{|p_R - p_L|}{|p_L + p_R|}$$

Here, α denotes the left compensation gain, β denotes the right compensation gain, $P_L$ denotes the power of the first left signal L1 and $P_R$ denotes the power of the first right signal R1.

When the absolute value with respect to the difference value between the power $P_L$ of the first left signal L1 and the power $P_R$ of the first right signal R1 is great, the left and right compensation gains α and β have small values. In particular, when there is only one of the first left and right signals L1 and R1, the values of the left and right compensation gains α and β are 0. When the absolute value with respect to the difference value between the power $P_L$ of the first left signal L1 and the power $P_R$ of the first right signal R1 is small, the left and right compensation gains α and β have great values.

The compensation gain calculating unit 22, for example, can calculate the power $P_L$ of the first left signal L1 and the power $P_R$ of the first right signal R1 using a reflexive method as shown in Equation 4.

$$P_L=P_L(n)=\gamma\cdot P_L(n-1)+(1-\gamma)\cdot(L1)^2(n)$$

$$P_R=P_R(n)=\gamma\cdot P_R(n-1)+(1-\gamma)\cdot(R1)^2(n) \qquad \text{(Equation 4)}$$

$P_L(n-1)$ denotes a previously accumulated power value and $(L1)^2(n-1)$ denotes current power of the first left signal L1. $P_R(n-1)$ denotes a previously accumulated power value and $(R1)^2(n-1)$ denotes current power of the first right signal R1. γ denotes a weight value for adapting the power value to changes in the first left and right signals L1 and R1. When the first left and right signals L1 and R1 are drastically changed, the weight value γ may have a small value, while having a great value when the first left and right signals L1 and R1 are not drastically changed.

Thus, the compensation gain calculating unit 22 calculates the power $P_L$ Of the first left signal L1 and the power $P_R$ of the first right signal R1 to thus calculate the left and right compensation gains which are inversely proportional to the absolute value with respect to the difference value between the power $P_L$ of the first left signal L1 and the power $P_R$ of the first right signal R1.

Then, the compensation mono component signal generating unit 23 uses the first multiplier 23*a* to multiply the mono component signal γ extracted by the mono component signal extracting unit 21 by the left compensation gain α calculated by the compensation gain calculating unit 22, and uses the second multiplier 23*b* to multiply the mono component signal γ by the right compensation gain β, thereby generating a compensation mono component signal to be compensated for the second left and right signals L2 and R2.

The generated compensation mono component signal is respectively added to the second left and right signals L2 and R2 to thus compensate the low frequency signals which have been attenuated when removing the crosstalk.

Hence, the signals L3 and R3 outputted from the adding unit 30 refers to signals with phases for removing the crosstalk, which are obtained by compensating the mono component signal by the left and right compensation gains. The signals L3 and R3 are got to the listener in a state that the low frequency signals have been compensated with maintaining the stereophonic sound effect through the left and right speakers $SP_L$ and $SP_R$.

Figure 5:
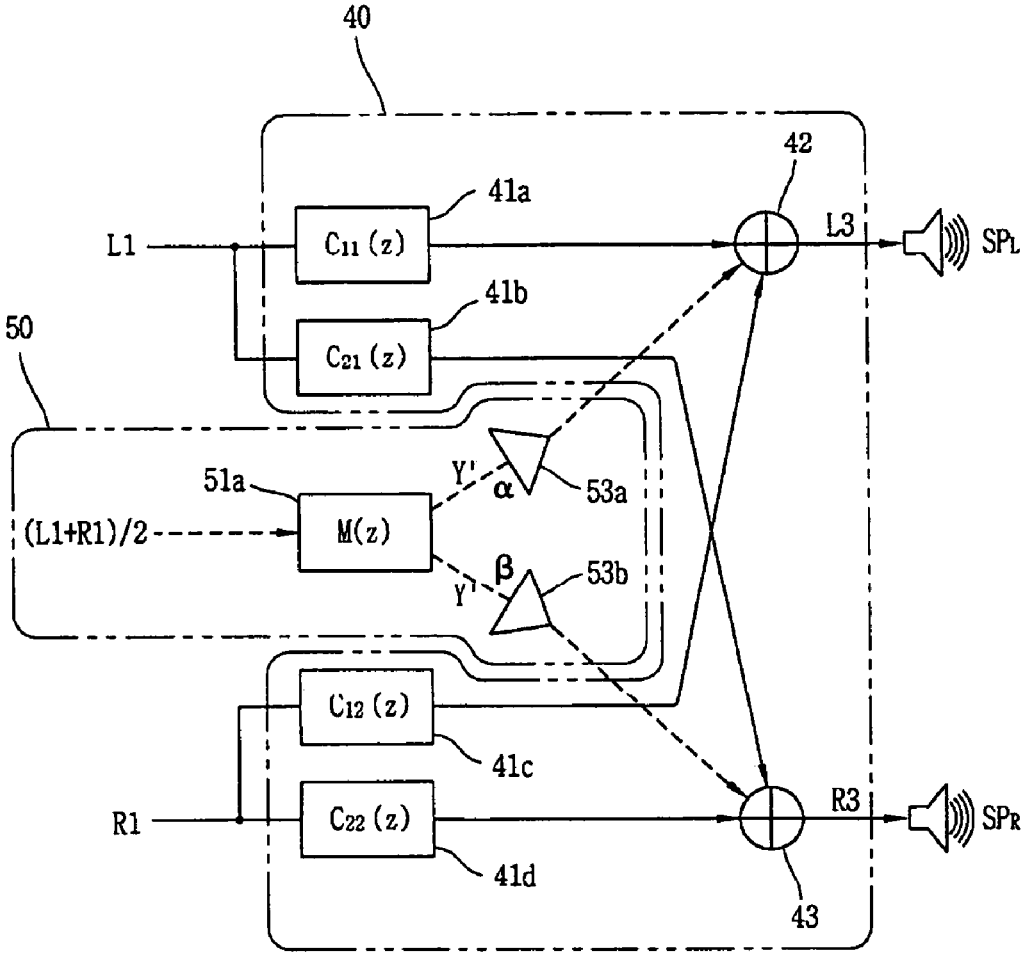
FIG. 5 is a diagram illustrating another embodiment of a detailed construction of the a stereophonic sound reproduction system for compensating the low frequency signal according to the present invention.

FIG. 5 illustrates another embodiment of the detailed construction of the stereophonic sound reproduction system for compensating the low frequency signal according to the present invention.

That is, the stereophonic sound reproduction system for compensating the low frequency signal illustrated in FIG. 5 can include a crosstalk removing unit 40 and a low frequency signal compensating unit 50.

The crosstalk removing unit 40 can be implemented as the commonly used crosstalk canceller. The crosstalk removing unit 40 can include first through fourth compensating filters 41*a* through 41*d* for compensating the first left and right signals L1 and R1 using a reverse function with respect to the special transfer function corresponding to each acoustic path, a first adder 42 for adding output signals from the first and third compensating filters 41*a* and 41*c* to each other to output the second left signal L2 having the phase for removing the crosstalk, and a second adder 43 for adding output signals from the second and fourth compensating filters 41*b* and 41*d* to each other to output the second right signal R2 having the phase for removing the crosstalk.

The low frequency signal compensating unit 50 can include a mono component signal extracting unit for extracting a mono component signal from the left and right signals, a compensation gain calculating unit for calculating the compensation gains using information related to a power difference between the left and right signals, and a compensation mono component signal outputting unit for adding the mono component signal of which amplitude has been adjusted according to the compensation gains to the left and right signals when removing the crosstalk of the left and right signals.

The mono component signal extracting unit can include a low frequency band pass filter 51*a* for extracting a mono component signal γ by performing a low pass filtering with respect to an average value between the first left and right signals L1 and R1 and then outputting the mono component signal γ which is thus synchronized with the output signals from the first and fourth compensating filters 41*a* through 41*d*.

The compensation mono component signal outputting unit can include first and second multipliers 53*a* and 53*b* for multiplying the left and right compensation gains α and β calculated using the power difference between the first left and right signals L1 and R1 by the mono component signal γ, respectively, and then outputting a left compensation mono component signal and a right compensation mono component signal to the first adder 42 and the second adder 43, respectively.

The low frequency signal compensating unit 50, on the other hand, may be constructed by including the low frequency band pass filter 51*a* for extracting a mono component signal γ by performing a low pass filtering with respect to an average value between the first left and right signals L1 and R1 and then outputting the mono component signal γ which is thus synchronized with the output signals from the first and fourth compensating filters 41*a* through 41*d*, and the first and second multipliers 53*a* and 53*b* for multiplying the left and right compensation gains α and β calculated using the power difference between the first left and right signals L1 and R1 by the mono component signal γ, respectively, and the outputting a left compensation mono component signal and a right compensation mono component signal to the first adder 42 and the second adder 43, respectively.

Explanation will be given for an operation of the stereophonic sound reproduction system for compensating the low frequency signal according to the present invention with such construction.

The crosstalk removing unit 40 is operated according to the same method used to operate the crosstalk removing unit 10 shown in FIG. 4.

The low frequency band pass filter 51*a* of the low frequency signal compensating unit 50 synchronizes the average value (L1+R1)/2 between the first left and right signals L1 and R1 with the output signals from the first through fourth compensating filters 41*a* through 41*d* for output thereof. Here, the outputted signal from the low frequency band pass filter 51*a* denotes a mono component signal γ'. The mono component signal γ' is calculated using the similar method to Equation 2. The mono component signal γ' is synchronized with the output signals from the first through fourth compensating filters 41*a* through 41*d*, so that the mono component signal γ' is different from the mono component signal γ calculated using Equation 2.

The first multiplier 53*a* of the low frequency signal compensating unit 50 multiplies the output signal (i.e. the mono component signal γ') from the low frequency band pass filter 51*a* by the left compensation gain α to thereafter output the multiplied signal to the first adder 42 of the crosstalk removing unit 40. Furthermore, the second multiplier 53*b* of the low frequency signal compensating unit 50 multiplies the output signal (i.e., the mono component signal γ') from the low frequency band pass filter 51*a* by the right compensation gain β, to thereafter output the multiplied signal to the second adder 43 of the crosstalk removing unit 40.

Accordingly, the stereophonic sound reproduction system for compensating the low frequency signal illustrated in FIG. 5 is not separately equipped with the adder 30 illustrated in FIG. 4.

Hence, the attenuation of the mono signal generated from the stereophonic sound reproduction system based upon the existing crosstalk canceller can be solved by compensating the mono component signal having the controlled amplitude using each of the left and right compensation gains. Accordingly, a person can listen an audio signal from which the crosstalk signal is removed and for which the mono component is enhanced.

As described above, regarding the stereophonic sound reproduction system for compensating the low frequency signal according to the present invention, by extracting the mono component signal by performing the low pass filtering with respect to the average value between the left and right signals, and then compensating the mono component signal according to the left and right compensation gains which are calculated to be inversely proportional to the absolute value of the power difference between the left and right signals, the low frequency signals which are attenuated when removing the crosstalk can be effectively compensated even by performing the less number of times for calculations.

In the present invention, the distortion of the original stereophonic sound can be prevented with maintaining the stereophonic sound effect by removing the crosstalk and compensating the low frequency signals which are attenuated when removing the crosstalk.

Since the low frequency signals attenuated when removing the crosstalk can be compensated with the less number of times that the calculation is performed, the stereophonic sound reproduction system for compensating the low frequency signal according to the present invention can be effectively applied to small terminals (e.g., mobile communications terminals, MP3 players, CD playbacks, and the like) which have several restrictions on usage when reproducing the stereophonic sound thereby.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A stereophonic sound reproduction system for compensating a low frequency signal, the system comprising:

a crosstalk removing unit configured to generate left and right speaker input signals by removing cross-talk from the stereophonic sound, the stereophonic sound comprising left and right signals;

a mono component signal extracting unit configured to extract a mono component signal from the stereophonic sound by performing low pass filtering;

a compensation gain calculating unit configured to calculate left and right compensation gains based on a power difference between the left and right signals of the stereophonic sound;

a compensation mono component signal generating unit configured to generate left and light compensation mono component signals by multiplying the extracted mono component signal by the calculated left and right compensation gains; and an adder configured to generate final speaker input signals by adding the left speaker input signal to the left compensation mono component signal and adding the right speaker input signal to the right compensation mono component signal, wherein the left and right compensation gains are increased when the absolute value of the power difference between the left and right signals of the stereophonic sound is decreased.

2. The system of claim 1, wherein the mono component signal is an average value between the left and right signals of the stereophonic sound and the mono component signal extracting unit is a low frequency band pass filter.

3. The system of claim 1, wherein the crosstalk removing unit includes:

first through fourth compensating filters to compensate the left and right signals of the stereophonic sound using a reverse function of a special transfer function corresponding to each acoustic path;

a first adder to add output signals from the first and third compensating filters to remove the crosstalk; and a second adder to add output signals from the second and fourth compensating filters to remove the crosstalk.

4. The system of claim 1, further comprising a low frequency signal compensating unit that includes first and second multipliers configured to multiply the extracted mono component signal by the calculated left and right compensation gains to generate the left and right compensation mono component signals.

5. The system of claim 4, further comprising a delay unit configured to delay the left and right compensation mono component signals for synchronizing the left and right compensation mono component signals with the left and right speaker input signals.

6. The system of claim 3, wherein the mono component signal extracting unit extracts the mono component signal using an equation:

$$Y=[(L1+R1)/2]*M(z),$$

wherein (L1+R1)/2 denotes an average value between first left and first right signals (L1 and R1), M(z) denotes a low frequency band pass filter including delay required for synchronizing the (L1+R1)/2 with output signals from the first through fourth compensating filters of the crosstalk removing unit, * denotes a convolution calculation, and Y denotes the extracted mono component signal.

7. The system of claim 1, wherein the compensation gain calculating unit calculates the left and right compensation gains using an equation:

$$\alpha = 1 - \frac{|p_L - p_R|}{|p_L + p_R|}$$

$$\beta = 1 - \frac{|p_R - p_L|}{|p_L + p_R|}.$$

wherein α denotes the left compensation gain, β denotes the right compensation gain, $P_L$ denotes a power of a first left signal and $P_R$ denotes a power of a first right signal.

8. The system of claim 7, wherein the power of the first left signal is calculated using an equation:

$$P_L=P_L(n)=\gamma\cdot P_L(n-1)+(1-\gamma)\cdot L^2(n),$$

wherein $P_L(n-1)$ denotes a previously accumulated power value, $L^2(n-1)$ denotes current power of the first left signal and γ denotes a weight value for adapting $P_L$ to a change in the first left signal.

9. The system of claim 7, wherein the power of the first right signal is calculated using an equation:

$$P_R=P_R(n)=\gamma\cdot P_R(n-1)+(1-\gamma)\cdot R^2(n)$$

wherein $P_R(n-1)$ denotes a previously accumulated power value, $R^2(n-1)$ denotes current power of the first right signal and γ denotes a weight value to adapt $P_R$ to a change in the first right signal.

10. The system of claim 1, further comprising left and right speakers to receive, respectively, the left and right speaker input signals from the crosstalk removing unit.

11. A stereophonic sound reproduction method for compensating low frequency signals, the method comprising:

generating left and right speaker signals by removing cross-talk from the stereophonic sound, the stereophonic sound comprising left and right signals;

extracting a mono component signal from the stereophonic sound by performing low pass filtering;

calculating left and right compensation gains based on a power difference between the left and right signals of the stereophonic sound;

generating left and right compensation mono component signals by controlling an amplitude of the extracted mono component signal according to the left and right compensation gains; and generating final speaker input signals by adding the left speaker input signal to the left compensation mono component signal and adding the right speaker input signal to the right compensation mono component signal, wherein the left and light compensation gains are increased when the absolute value of the power difference between the left and right signals of the stereophonic sound is decreased.

12. The method of claim 11, wherein the mono component signal is extracted using an equation:

$$Y=[(L+R)/2]*M(z),$$

wherein, (L1+R1)/2 denotes an average value between first left and right signals (L1 and R1), M(z) denotes a low frequency band pass filter including delay required for synchronizing (L1+R1)/2 with second left and right signals (L2 and R2) from which the crosstalk has been removed, * denotes a convolution calculation, and Y denotes the extracted mono component signal.

13. The method of claim 11, wherein the left and right compensation gains are calculated using an equation:

$$\alpha = 1 - \frac{|P_L - P_R|}{|P_L + P_R|}$$

-continued $$\beta = 1 - \frac{|P_R - P_L|}{|P_L + P_R|},$$

wherein α denotes the left compensation gain, β denotes the right compensation gain, $P_L$ denotes a power of a first left signal and $P_R$ denotes a power of a first right signal.

14. The method of claim 13, wherein the power of the first left signal is calculated using an equation:

$$P_L=P_L(n)=\gamma\cdot P_L(n-1)+(1-\gamma)\cdot L^2(n),$$

wherein $P_L(n-1)$ denotes a previously accumulated power value, $L^2(n-1)$ denotes current power of the first left signal and γ denotes a weight value for adapting the power $P_L$ to a change in the first left signal.

15. The system of claim 13, wherein the power of the first right signal is calculated using an equation:

$$P_R=P_R(n)=\gamma\cdot P_R(n-1)+(1-\gamma)\cdot R^2(n),$$

wherein $P_R(n-1)$ denotes a previously accumulated power value, $R^2(n-1)$ denotes current power of the first right signal and γ denotes a weight value to adapt $P_R$ to a change in the first right signal.

* * * * *